United States Patent [19]

Klein

[11] 4,412,154

[45] Oct. 25, 1983

[54] START UP FREQUENCY ADJUSTMENT IN AN ELECTRONIC POWER DEVICE FOR A DISCHARGE LAMP

[75] Inventor: Denys C. Klein, Orsay, France

[73] Assignee: Compagnie de Signaux et d'Entreprises Electriques, Paris, France

[21] Appl. No.: 277,392

[22] Filed: Jun. 25, 1981

[30] Foreign Application Priority Data

May 20, 1981 [FR] France ..... 81 10056

[51] Int. Cl.[3] ..... H05B 41/36

[52] U.S. Cl. ..... 315/224; 315/208; 315/225; 315/287; 315/307

[58] Field of Search ..... 315/208, 209 R, 224, 315/225, 287, 291, 307, DIG. 5, DIG. 7

[56] References Cited

U.S. PATENT DOCUMENTS

| | | | |
|---|---|---|---|
| 3,710,177 | 1/1973 | Ward | 315/DIG. 5 |
| 3,999,100 | 12/1976 | Dendy et al. | 315/287 X |
| 4,060,752 | 11/1977 | Walker | 315/224 X |
| 4,240,009 | 12/1980 | Paul | 315/287 X |
| 4,259,614 | 3/1981 | Kohler | 315/224 S |
| 4,277,728 | 7/1981 | Stevens | 315/307 |

*Primary Examiner*—Eugene La Roche

*Attorney, Agent, or Firm*—Birch, Stewart, Kolasch and Birch

[57] ABSTRACT

An electronic drive system for a discharge lamp is disclosed wherein the switching frequency of the chopper is reduced until the lamp striking voltage has reached about 70% of its rated value. The system includes a chopper transistor, a control for varying the transistors duty cycle and a smoothing inductance, freewheeling diode and smoothing inductor to smooth the chopper output. Current limiting is provided to prevent overcurrent within the chopper transistor, smoothing inductor or lamp.

5 Claims, 6 Drawing Figures

START UP FREQUENCY ADJUSTMENT IN AN ELECTRONIC POWER DEVICE FOR A DISCHARGE LAMP

BACKGROUND OF THE INVENTION

The present invention relates to an electronic power supply device for driving a discharge lamp, comprising a switching regulator formed by a chopper transistor driven with a variable cyclic ratio through a driver stage, a smoothing inductance, a freewheel diode and a smoothing capacitor.

Such power supply devices are particularly adapted to control the brightness of discharge lamps to be dosed, and more especially of the so-called "daylight lamps" which equip stage lighting projectors. In order to offer a good reproduction of colors, these lamps generally receive a compound filling based on argon, mercury, halogens and rare earths. The operation of the lighting, such as bringing the lamp up to temperature, maintaining the lamp under established operating conditions and relighting the lamp after extinction require special precautions on the part of the power supply manufacturer because of the transitory phenomena which appears in the solid, liquid or gaseous substances of the filling on the one hand and because of excessive transient voltages or currents which affect the electric or electronic components on the other hand.

During the cold lighting phase, which lasts from half a minute to three minutes depending on the type and the rated power, the voltages required for driving the lamp increase considerably. An ordinary regulated power supply is not suitable, even if it is adapted to regulate either a current, a voltage, or an electric power. The aim of the invention is therefor to program the successive phases of bringing the lamp into service in accordance with a sequence which takes into account the requirements related to safety, reliability and the rapidity of temperature rise, without the life expectancy and the dosability of the light which it emits being altered.

To this end, the electronic power supply device of the present invention comprises means for lowering the switching frequency of the copper transistor during the heating-up period of the lamp until its striking voltage has reached about 70% of its rated value.

With this arrangement, the conduction period $\tau$ of the chopper transistor may be increased beyond the time for establishing the current in said transistor, while increasing the DC component of the current delivered, which allows the rate of temperature rise of the lamp to be increased.

In a particular embodiment of the invention, said means for lowering the frequency comprise an analog gate sensitive to the striking voltage acting on the time constant of an oscillator driving the driver stage through a cyclic ratio modulator.

According to another characteristic of the invention, the power supply device comprises an electronic cut-out switch, responsive to the current delivered by the chopper transistor, so as to shunt the driving of the driver stage when this current exceeds a maximum predetermined value.

This cut-out switch will for example be formed by a threshold device controlling the conduction of a transistor connected in parallel across the input of the driver stage.

The action of such a cut-out switch is equivalent to shortening the conduction time $\tau$ of the chopper transistor, thus causing the growth of the instantaneous current to be stopped.

Generally, a resistor is inserted upstream of the regulator, so as to limit the surge current during the switching on of the power supply device. According to yet another characteristic of the invention, this resistor is connected in parallel with a thyristor or triac whose gate electrode is continuously supplied from a secondary winding wound on the smoothing inductance, through a rectifier, a smoothing capacitor and a resistive adapter.

Thus, the resistance for limiting the surge current is automatically shunted as soon as the chopper transistor begins to operate.

BRIEF DESCRIPTION OF THE DRAWINGS

Several preferred embodiments of the invention are described hereafter by way of examples, with reference to the accompanying drawings in which.

Figure 1:
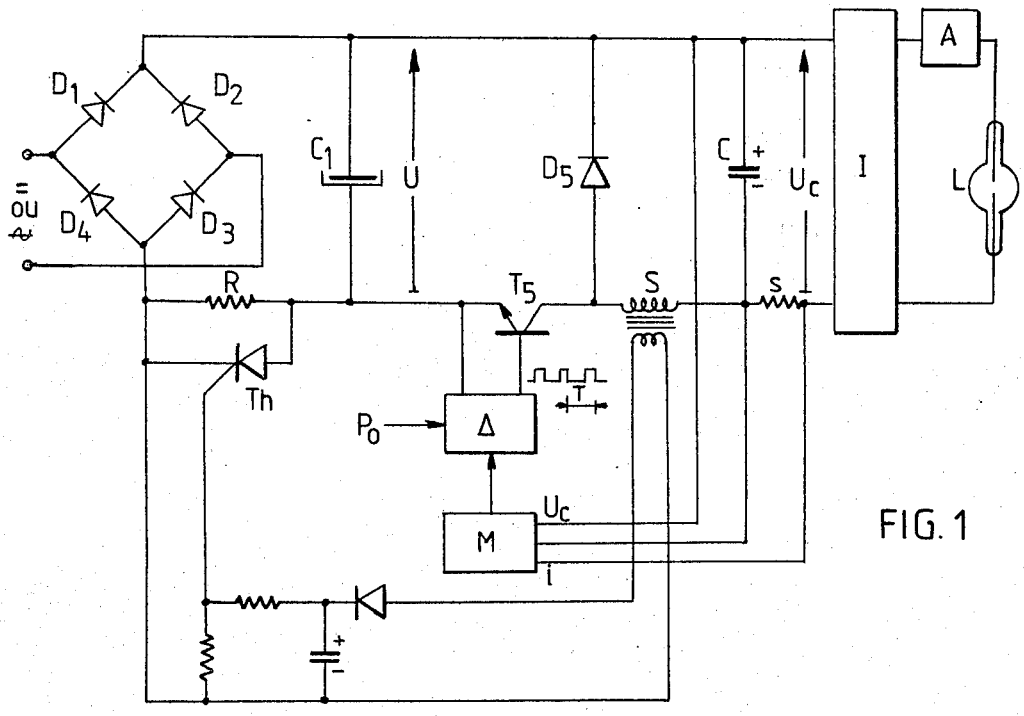
FIG. 1 is a simplified partial block diagram of a power supply device for a discharge lamp in accordance with the invention.

The device shown in FIG. 1 comprises first of all a conventional-type switching regulator, formed essentially by a chopper transistor $T_5$, a smoothing inductance S, a freewheel diode $D_5$ and a smoothing capacitor C. A polarity inverter I is place downstream of the regulator so as to avoid cataphoresis of the electrodes of the discharge lamp L which is connected in series with an igniter A.

Upstream of the regulator we find a rectifier bridge with four diodes $D_1$, $D_2$, $D_3$ and $D_4$ as well as a capacitor $C_1$ whose role is to store energy in electrostatic form, so as to meet the needs of the lamp when the AC voltage of the input lines passes close to zero.

If we call $\tau$ the time during which the chopper transistor $T_5$ is enabled and $T-\tau$ the time during which it is disabled, the ratio between the output voltage $U_c$ and the input voltage U is approximately given by $U_c/U=\tau/T$. The cyclic conduction ratio $\tau/T$ of the chopper is defined by a comparator $\Delta$ capable of using the difference between the signal representing the reference power $P_o$ and the signal representing the true power delivered at the output. The electrical expression of this true power is obtained from an analog device M driven both by the voltage $U_c$ and by the current i, through a measuring shunt s inserted in the path of the output current. The analog device M may be either a multiplier providing the product of voltage $U_c$ multiplied by current i, or a weighted adder providing the sum a $U_c$+bi. The modification of the power reference $P_o$ causes a signal for modifying the cyclic ratio to be output by comparator $\Delta$, so as to maintain the true power very close to $P_o$. It is thus possible to control at will the light flow emitted by the lamp under steady operating conditions, or to finely adjust the colour temperature of its radiation, by simply changing the reference power $P_o$. However, and as will be seen more clearly further on, this reference is only taken into account once the lamp is hot, for the imposition of a high power $P_o$ would result, under low striking voltage operating conditions, in an excess current which the chopper transistor $T_5$, the smoothing inductance S or lamp L could not withstand.

Since the charge on capacitor $C_1$ is due to integration of the current drawn from the input lines, it is customary to insert in the path of this latter a resistance or thermistance R so that the excess current remains admissible even if the bringing into service takes place when the mains voltage passes through its maximum. So as to overcome the voltage drop which this resistance or this thermistance would cause under steady operating conditions, there is provided in accordance with the invention a thyristor Th connected in parallel which shunts it out once the chopper has begun to operate. For this purpose, the gate of Th is driven continuously from a secondary winding coupled magnetically to the smoothing inductance S, through a rectifier, a smoothing capacitor and a resistive adapter. Connected as a peak detector, this device provides a rectified driving voltage which fluctuates little despite the cyclic ratio variations of the chopper.

Figure 2:
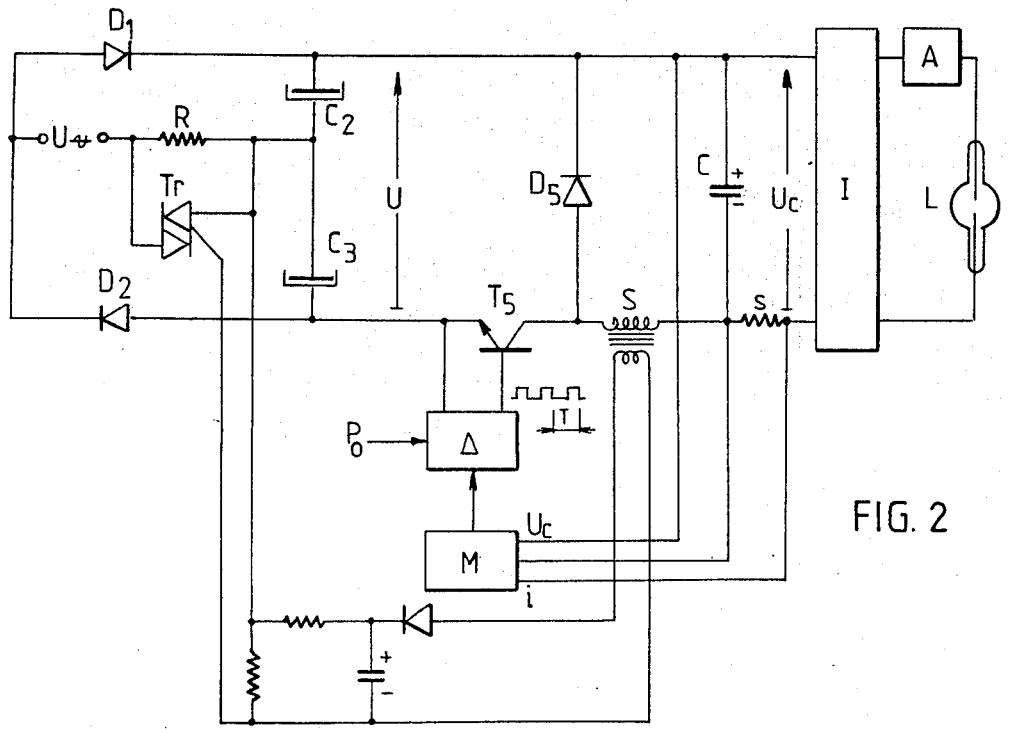
FIG. 2 is a diagram similar to that of FIG. 1 of another embodiment using a voltage doubler.

In the embodiment shown in FIG. 2, the circuit situated upstream of the regulator forms a voltage doubler with two diodes $D_1$, $D_2$ and capacitors $C_2$ and $C_3$. The resistor R for limiting the surge current is then connected in parallel with a triac Tr whose gate is driven continuously under the same conditions as previously.

In the phase which follows charging of capacitor $C_1$ or of capacitors $C_2$ $C_3$, the regulator generates a high voltage at the terminals of smoothing capacitor C, typically 250 volts, so that the ionization of the plasma triggered by the train of sparks of the igniter A may be then maintained.

Since the striking voltage across a cold lamp is low, typically from 5 to 20 volts, it is advantageous to regulate the average current which passes therethrough to a value greater than the rated current so as to speed of the lamp the warming up. This is facilitated by the fact that the AC component of the current flowing through S has a low amplitude I when $\tau$ is low. Without exceeding the maximum current $I_M$ able to be supported by the transistor, the initial DC component $I_o$ may then be raised. $\tau$ may even be increased without danger provided that T is increased in the same proportion so that the ratio $\tau/T$ continues to determine the ratio $U_c/U$. The advantage of an increase in $\tau$ resides in the fact that the times for establishing the collector current are not inconsiderable (typically 0.5 microsecond). By way of numerical example, if we adopted for T a typical period of 40 microseconds, the time $\tau$ would be when cold about 1 microsecond. It is advantageous to increase this time, in a ratio of about 2, so that each order for conducting or nonconducting arrives after quenching of the preceding transitory operating conditions. The danger which may arise in raising the DC component and in increasing time $\tau$ comes from possible saturation of the magnetic material on which inductance S is wound, and from the possible overshooting of the current which the chopper transistor $T_5$ may deliver without excessive waste voltage, considering the basic drive to which it is subjected in the enabled condition.

In accordance with the present invention, this danger is averted by means of an electronic cut-out switch operating from a current sensor inserted in the path of the current delivered by $T_5$, or by means of a frequency reducer placed in the all-or-nothing drive of the chopper. Since the voltage delivered across the smoothing capacitor C must be low when cold, the cyclic ratio $\tau/T$ is advantageously made small by an increase in the time T. In other words, the sawtooth wave which represents the current in the inductance to which a square-wave voltage is applied offers a fairly long rise time so that the current delivered by transistor $T_5$ has the time to be established.

In the device of the present invention, the information used to lower the frequency of the chopper makes use of the low striking voltage value when cold. The operation of this chopper at half-frequency, for example, is maintained as long as the striking voltage remains less than about 70% of the rated voltage.

Figure 3:
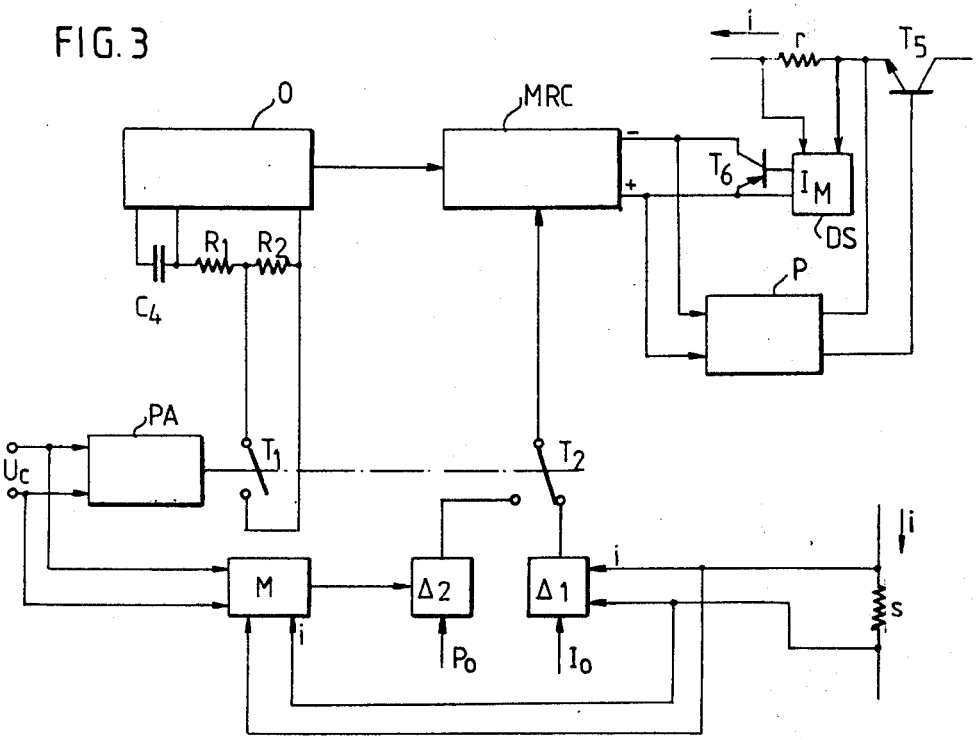
FIG. 3 is a partial diagram showing one practical embodiment of certain arrangements in accordance with the invention.

Referring now to the diagram of FIG. 3, a practical embodiment of the electronic cut-out switch and of the frequency reducer of the invention will now be described. In this diagram, there can be seen first of all an all-or-nothing oscillator O supplying a cyclic ratio modulator MRC which in its turn supplies a driver stage P for driving the chopper transistor $T_5$.

The frequency of oscillator O is tied to a modifiable time constant formed by a capacitor $C_4$ and two resistors $R_1$, $R_2$. Resistor $R_2$ may be shunted by means of a contact $T_1$ controlled by an analog gate PA responsive to the striking voltage $U_c$ of the lamp. This analog gate is equivalent to a relay whose energization voltage would be equal to 70% of the rated striking voltage.

Analog gate PA also controls the operation of a second contact $T_2$ for switching to modulator MRC either the current comparator $\Delta_1$ or the power comparator $\Delta_2$.

The comparator $\Delta_1$ receives the initial reference current $I_o$ and the information relative to the average current i of the lamp through the measuring shunt s.

Comparator $\Delta_2$ receives the reference power $P_o$ and the information relative to the true power through the analog device M.

The diagram is completed by a threshold device DS responsive to the current delivered by the chopper transistor $T_5$ by means of a second shunt r inserted in the circuit. This threshold device is adjusted to the maximum admissible current $I_M$ and controls the operation of a transistor $T_6$ connected in parallel across the input of driver stage P.

Figure 4:
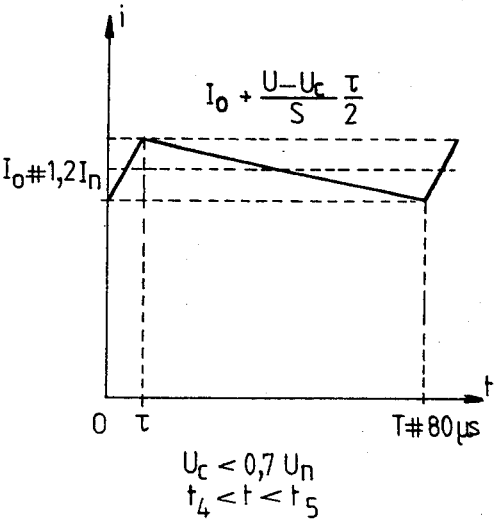
FIG. 4 is a diagram showing the trend of the current when the lamp is cold.

When the lamp is cold, its striking voltage is low and cannot trigger the analog gate PA which is driven by the voltage $U_c$, the image of the striking voltage of the lamp. Consequently, the period of oscillator O is proportional to the time constant $(R_1+R_2)\,C_4$, i.e. typically 80 microseconds, since the contact $T_1$ is then at rest. Similarly, contact $T_2$ is also at rest, so that the cyclic ratio modulator MRC operates by comparison $\Delta_1$ between the current actually delivered to the lamp and the initial reference current $I_o$, chosen in general equal to 1.2 times the rated current. This current has the trend shown in FIG. 4, with a wave centred on the DC component $I_o$. In the ascending phase, the current increases with a slope $(U-U_c)/S$ until it reaches the peak value $I_o+[(U-U_c)/S]\tau/2$. As long as this peak value does not exceed the value $I_M$ of the maximum current which transistor $T_5$ may deliver, the signal output by the cyclic ratio modulator MRC is freely directed towards the driver stage P which drives chopper $T_5$. But if the current conveyed by this latter exceeds $I_M$, a cut-out is ensured by threshold device DS which shunts the driving of the driver stage P through enabling of transistor $T_6$. The effect of this cut-out would be the same if $\tau$ were short, and $T-\tau$ lengthened correspondingly.

Figure 5:
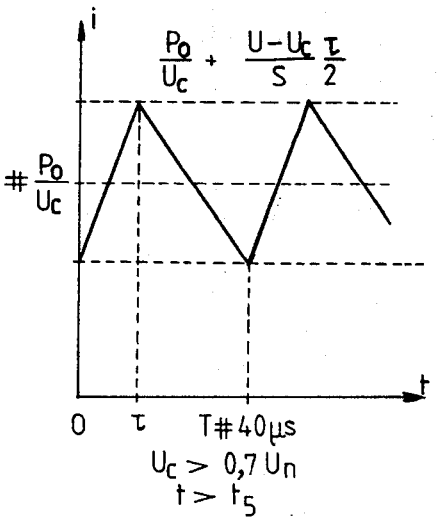
FIG. 5 is a diagram showing the trend of the current when the lamp is hot.

When the lamp is sufficiently hot, the voltage $U_c$ rises above the threshold of 70% of its rated value, and the analog gate PA engages the work contact $T_1$ which shunts $R_2$, thus reducing time T to the typical value of 40 microseconds. Simultaneously, contact $T_2$ is engaged in its work position and substitutes, for driving the cyclic ratio modulator MRC, the current comparator $\Delta_1$ by the power comparator $\Delta_2$. This latter operates by sensing the average current of the lamp by means of the measuring shunt s, and measures the voltage $U_c$ close to the striking voltage, the multiplier or weighted adder M providing the product of these two parameters. The trend of the current is then that shown in FIG. 5, with a wave which is centred on a DC component very close to $P_o/U_c$, $P_o$ being the reference power. The AC component $[(U-U_c)/S]\tau/2$ is higher than previously, because of the increased value of $\tau$ (typically 15 microseconds), but there is little chance that the current peak exceeds $I_M$ since the DC component $P_o/U_c$ is generally smaller than $I_o$. If nevertheless this peak value should exceed $I_M$, the electronic cut-out switch would act as previously by shunting the drive for the driver by means of transistor $T_6$.

Figure 6:
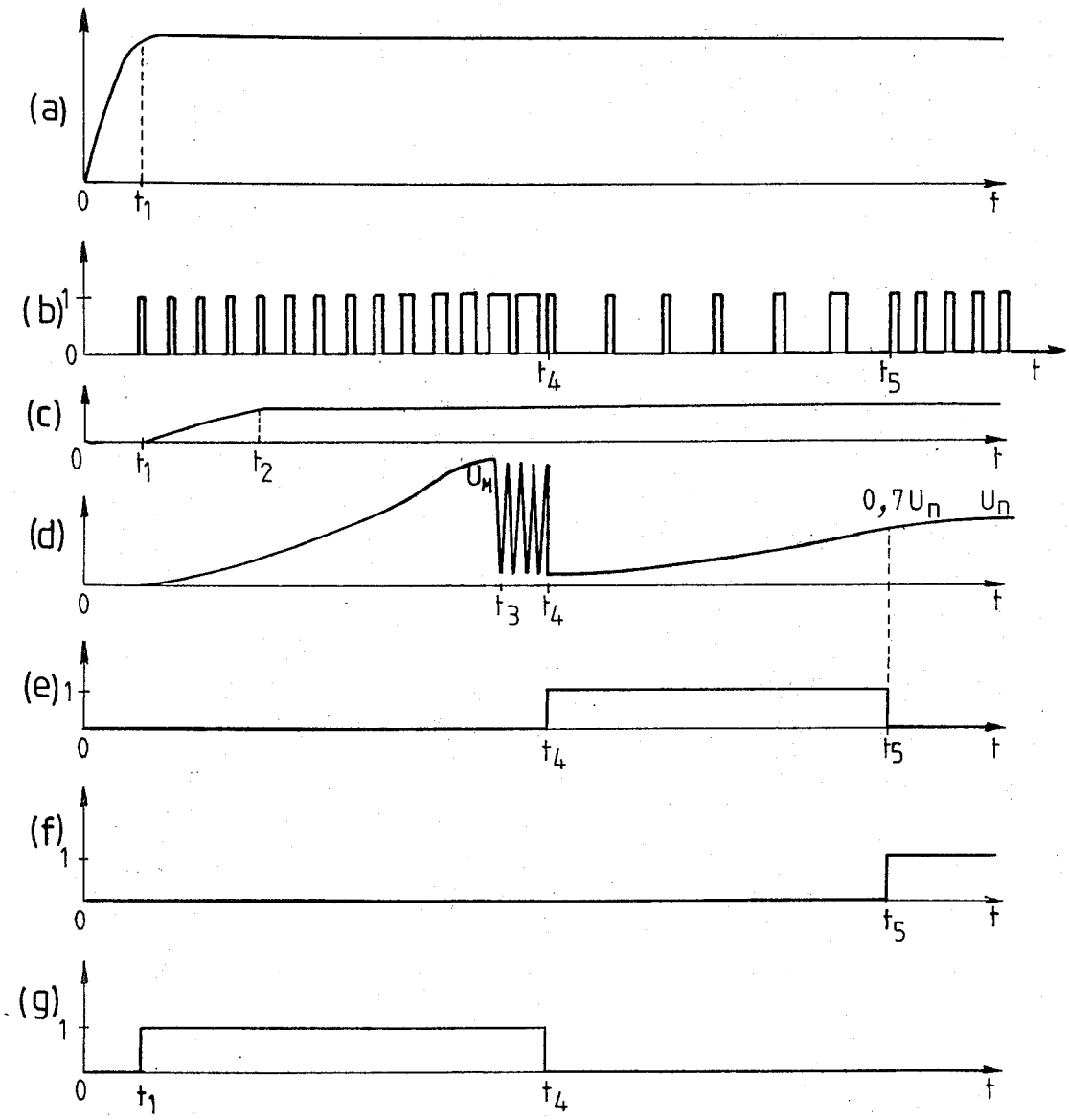
FIGS. 6*a* to 6*g* show different diagrams illustrating the operation of the device of the invention.

In order to recapitulate the different functions assumed by the power supply device of the invention, reference will now be made to the diagram of FIG. 6 which illustrates the successive phases of the cycling up of the discharge lamp, from time t=0 when the supply is switched on:

Until time $t_1$, the reservoir capacitor $C_1$ or the reservoir capacitors $C_1$, $C_2$ are charged through the resistance or thermistance R protecting the rectifier bridge $D_1$, $D_2$, $D_3$ and $D_4$ or the doubler $D_1$, $D_2$ against any excessive current. The trend of the voltage at the terminals of these capacitors is shown by diagram *6a*.

Between times $t_1$ and $t_2$, the driver stage P drives the base of chopper transistor $T_5$ with an increasing cyclic ratio, as shown in Diagram *6b*, so as to progressively charge the smoothing capacitor C. The result is at the terminals of the smoothing inductance S a square-wave voltage and at the terminals of the secondary winding a voltage which, after rectification and smoothing, drives the gate of thyristor Th or triac $T_r$ charged with shunting R, as illustrated by Diagram *6c* which represents precisely the gate voltage of the thyristor or triac.

Between times $t_2$ and $t_3$, the regulator operates as a high cyclic ratio voltage generator, so that there is established at the terminals of capacitor C a fairly high voltage (typically 250 volts). The trend of the voltage delivered by the regulator is shown by Diagram *6d*.

Between times $t_3$ and $t_4$ igniter A is coupled in which produces a train of high-voltage and high-frequency sparks in the lamp causing ionization of the plasma, which appears clearly from Diagram *6d*.

Between times $t_4$ and $t_5$, the regulator operates under imposed current conditions, because of the action of comparator $\Delta_1$, with a reduced chopping frequency taking into account a reference value advantageously higher than the rated current, so as to speed up the rise in temperature and in striking voltage of the lamp.

From time $t_5$, marked by the striking voltage passing to about 70% of the rated voltage, the chopping frequency is re-established at its usual value, through the analog gate PA acting on contact $T_1$. Simultaneously, the engagement of contact $T_2$ switches to cyclic radio modulator MRC the comparator $\Delta_2$ instead of comparator $\Delta_1$. The magnitude taken into consideration by the regulator is then the power $U_c i$ consumed by the lamp (or, in a variation, the analog linear expression a $U_c+b$ i). This magnitude is continuously compared with the reference power $P_o$, fixed or variable as desired by the user, the difference determining the cyclic ratio $\tau/T$ of the square-waves applied to the chopper.

Diagram *6e* illustrates the operation of the regulator between times $t_4$ and $t_5$, with a reduced frequency and an increased current reference. Diagram *6f* illustrates the operation of the regulator from time $t_5$, with normal frequency and at a rated or reduced power reference which may furthermore be variable if desired by the user. As for Diagram *6g*, it illustrates the operation of the regulator between times $t_1$ and $t_4$, with normal frequency and a maximum voltage reference $U_M$.

It should moreover be noted that in case of extinction, desired or not, of the discharge lamp, it is possible to reignite it by repeating the initial timing. Certain phases thereof, in particular the phase $t_4$–$t_5$, may be shortened the shorter, the period of interruption has been. In fact the striking voltage may have a value considerably higher than when cold if the heat accumulated during ignition has been conserved during extinction.

I claim:

1. An electronic power supply device for a discharge lamp including a switching regulator formed by a chopper transistor driven with a variable cyclic ratio through a driver stage, a smoothing inductance, a freewheel diode and a smoothing capacitor, further comprising:

means for lowering the switching frequency of the chopper transistor during the heating-up period of the lamp until its striking voltage has reached about 70% of its rated value.

2. The electronic supply device as claimed in claim 1 wherein said means for lowering the frequency comprise an analog gate sensitive to the striking voltage acting on the time constant of an oscillator driving the driver stage through a cyclic ratio modulator.

3. The electronic power supply device as claimed in claim 1 or 2 further comprising an electronic cut-out switch responsive to the current delivered by the chopper transistor for shunting the driving of the driver stage when this current exceeds a maximum predetermined value.

4. The electronic supply device as claimed in claim 3 wherein the cut-out switch is formed by a threshold device controlling the conduction of a transistor connected in parallel across the input of the driver stage.

5. The electronic power supply device, as claimed in claim 1, further comprising a resistor inserted upstream of the regulator so as to limit the surge current during switching on, said resistor being connected in parallel with a thyristor or a triac whose gate is continuously fed from a secondary winding wound on the smoothing inductance, through a rectifier, a smoothing capacitor and a resistive adapter.

* * * * *